US008138862B2

(12) United States Patent
Mueller et al.

(10) Patent No.: US 8,138,862 B2
(45) Date of Patent: Mar. 20, 2012

(54) DOUBLE BREAK INSTALLATION SWITCHGEAR

(75) Inventors: Ralf Mueller, Germersheim (DE); Frank Hustert, Waghaeusel (DE); Hans-Peter Weyand, Bellheim (DE)

(73) Assignee: ABB AG, Mannheim (DE)

( * ) Notice: Subject to any disclaimer, the term of this patent is extended or adjusted under 35 U.S.C. 154(b) by 293 days.

(21) Appl. No.: 12/516,019

(22) PCT Filed: Nov. 8, 2007

(86) PCT No.: PCT/EP2007/009670

§ 371 (c)(1),
(2), (4) Date: May 22, 2009

(87) PCT Pub. No.: WO2008/061630

PCT Pub. Date: May 29, 2008

(65) Prior Publication Data

US 2010/0019873 A1 Jan. 28, 2010

(30) Foreign Application Priority Data

Nov. 22, 2006 (DE) ..... 10 2006 055 007

(51) Int. Cl.
*H01H 9/00* (2006.01)
*H01H 75/00* (2006.01)
*H01H 67/02* (2006.01)

(52) U.S. Cl. ..... 335/172; 335/6; 335/14; 335/15; 335/131; 335/132; 335/174; 335/175; 335/176; 335/185; 200/237; 200/243

(58) Field of Classification Search ..... 335/6, 14–15, 335/20, 104, 131–132, 172–178, 185, 193, 335/202; 200/237–243, 288
See application file for complete search history.

(56) References Cited

U.S. PATENT DOCUMENTS 3,944,954 A * 3/1976 Ellenberger ..... 335/35
4,307,358 A * 12/1981 Haury et al. ..... 335/6
4,467,300 A * 8/1984 Harbauer ..... 335/131

(Continued)

FOREIGN PATENT DOCUMENTS

AT 207933 3/1960

(Continued)

OTHER PUBLICATIONS

German Search Report of German Application DE 10 2008 016 036.9 mailed Aug. 13, 2008.

*Primary Examiner* — Mohamad Musleh
(74) *Attorney, Agent, or Firm* — Leydig, Voit & Mayer, Ltd.

(57) ABSTRACT

An installation switching device having at least one pole current path comprises two stationary contact pieces; a moving contact bridge including two moving contact pieces forming a double-break pole with the two stationary contact pieces; a contact pressure spring exerting a pressure on the moving contact bridge in a closing direction of the moving contact bridge; a pusher configured to act on the moving contact bridge counter to the pressure of the contact pressure spring in an opening direction, the pusher including a slide and a striking pin disposed moveably relative to the moving contact bridge and to one another in a movement direction of the moving contact bridge; a switch latch having a latching point; an operating lever configured to act on the pusher; and an electromagnetic release having an impact armature.

9 Claims, 7 Drawing Sheets

U.S. PATENT DOCUMENTS

| | | | | | |
|---|---|---|---|---|---|
| 4,470,028 | A | * | 9/1984 | Vayre et al. | 335/16 |
| 4,616,117 | A | | 10/1986 | Kleine | |
| 4,855,698 | A | * | 8/1989 | Cohen et al. | 335/14 |
| 4,893,102 | A | | 1/1990 | Bauer | |
| 4,982,060 | A | | 1/1991 | Streich et al. | |
| 5,163,175 | A | * | 11/1992 | Mori et al. | 335/132 |
| 5,218,332 | A | | 6/1993 | Blanchard et al. | |
| 5,233,321 | A | | 8/1993 | Blanchard et al. | |
| 5,276,417 | A | | 1/1994 | Blanchard et al. | |
| 5,300,906 | A | * | 4/1994 | Blanchard et al. | 335/167 |
| 5,339,060 | A | * | 8/1994 | Blanchard et al. | 335/132 |
| 5,546,062 | A | * | 8/1996 | Duchemin | 335/132 |
| 5,635,886 | A | * | 6/1997 | Pichard | 335/132 |
| 5,886,602 | A | | 3/1999 | Burel et al. | |
| 6,150,909 | A | | 11/2000 | Meier | |
| 6,310,528 | B1 | * | 10/2001 | Kuboyama et al. | 335/132 |
| 6,833,777 | B2 | * | 12/2004 | Bollinger et al. | 335/6 |
| 6,924,449 | B2 | | 8/2005 | Duchemin et al. | |
| 7,692,522 | B2 | * | 4/2010 | Hartinger et al. | 335/131 |
| 2002/0130742 | A1 | * | 9/2002 | Jacq et al. | 335/132 |

FOREIGN PATENT DOCUMENTS

| | | |
|---|---|---|
| DE | 8805875 | 9/1989 |
| DE | 19540972 | 5/1997 |
| DE | 29714318 | 12/1997 |
| DE | 69614657 | 3/2002 |
| DE | 102006055007 | 5/2008 |
| EP | 0501844 | 9/1992 |
| WO | WO-2005062333 | 7/2005 |

* cited by examiner

DOUBLE BREAK INSTALLATION SWITCHGEAR

This is a U.S. National Phase Application under 35 U.S.C. §371 of International Application No. PCT/EP2007/009670 filed on Nov. 8, 2007, which claims priority to German Application No. DE 10 2006 055 007.2, filed on Nov. 22, 2006. The International Application was published in German as WO 2008/061630 on May 29, 2008 under PCI 21(2).

The invention relates to a double-break installation switching device.

BACKGROUND

Installation switching devices of this generic type, for example motor protection switches, have at least one pole current path, comprising two stationary contact pieces and two moving contact pieces which are arranged on a moving contact bridge and form a double-break pole switch with two contacts.

In this case, a pusher acts on the contact bridge in the opening direction, and a contact compression spring acts on it in the closing direction.

Furthermore, installation switching devices of this generic type have an electromagnetic release whose armature not only acts on the contact bridge via the pusher in the opening direction but also unlatches the latching point of a switch latch when a short-circuit current occurs in the pole current path, as a result of which the switch latch permanently acts on the contact bridge in the opening sense, against the force of the contact compression spring, via an operating lever.

Immediately after the striking on the contact bridge and thus the breaking of the short-circuit current in the pole current path, the electrodynamic recoil of the electromagnetic release collapses, and the force of the contact compression spring once again acts on the contact bridge in the direction of its closed position.

As a result of the greater mechanical inertia of the switch latch, compared with that of the system comprising the armature and the pusher, the operating lever lags behind the pusher movement in order to hold the contacts permanently open by means of the switch latch.

In unfavorable conditions, it is possible for the contacts to have already been closed again by the contact compression spring before the switch latch can provide permanent opening via the operating lever and the pusher. This is then referred to as contact bouncing, which is undesirable.

SUMMARY OF THE INVENTION

An aspect of the present invention is therefore to provide an installation switching device of this generic type with a better dynamic response for breaking short-circuit currents, while avoiding contact bouncing.

According to the invention, the pusher therefore comprises a slide and a striking pin which are arranged such that they can move relative to the contact bridge and relative to one another essentially in the movement direction of the contact bridge, with the arrangement comprising the slide, the striking pin, the contact bridge, the operating lever and the armature being designed such that, in the event of a short circuit, the armature strikes the contact bridge via the striking pin in the opening direction, with the slide lagging behind the striking pin before the operating lever permanently holds the contact bridge in the open position via the slide against the contact pressure force.

The pusher according to the invention is therefore formed from two parts. This makes it possible for a first part of the pusher, specifically the striking pin, to be accelerated very quickly by the armature in the event of a short circuit, because of its small mass, thus striking the contact bridge very quickly.

Once the contact bridge has been struck and the short-circuit current has thus been broken, the effect of the force of the armature on the striking pin also ends. The contact bridge is now pushed in the closing direction again, by the force of the contact compression spring.

The slide which, according to the invention, lags behind the striking pin as the second part of the pusher, can brake this opposing movement of the contact bridge, in such a way that the contact bridge is prevented from closing the contacts before the operating lever finally holds the contact bridge permanently in the open position, via the slide, with the operating lever lagging even further behind the striking pin because of the greater mechanical inertia of the switch latch.

The installation switching device according to the invention therefore results in very rapid striking of the contact bridge in the event of a short circuit, while at the same time preventing contact bouncing.

According to one particularly advantageous embodiment, the contact bridge is guided in a first opening of the slide such that it can move in its movement direction.

A further embodiment is highly advantageous, in which the striking pin is guided in a second opening of the slide such that it can move in the movement direction of the contact bridge. The guidance of the striking pin in the second opening of the slide is in this case advantageously designed such that, during its movement in the opening direction of the contact bridge and because of a friction force that exists between the striking pin and the slide, the striking pin drives this in the opening direction, lagging behind it.

According to one advantageous further embodiment, the slide has a first step in the first opening, which step forms an upper stop for the contact bridge. This ensures a very compact design. When the slide strikes the contact bridge during its movements, which lag behind the striking pin, in the opening direction of the contact bridge, then, via the first step which acts as the upper stop, it has a braking effect on the opposing movement of the contact bridge in the closing direction.

The slide advantageously has a second step on its outside, which step forms a point of action for the operating lever.

Furthermore, the arrangement comprising the striking pin, slide and contact bridge is advantageously designed such that the mass of the slide is equal to or greater than the sum of the masses of the striking pin and contact bridge. This results in the advantage that the force of the resetting spring on the contact bridge is less than the force which acts on the contact bridge as a result of the genetic energy of the striking pin during opening.

Even more advantageous is an embodiment in which the slide has a third step in the first opening in which the contact bridge is guided, which step forms a lower stop for the contact bridge. During its impact movement in the opening direction, the contact bridge first of all drives the slide a certain amount in the opening direction on the third step, and thus assists its movement, which lags behind the striking pin, in the opening direction. When the contact bridge is once again moved in the opposite direction, in the closing direction, as a result of the force of the contact compression spring after the electrodynamic recoil of the electromagnetic release has collapsed, then, in the embodiment described here, the slide is advanced even further in the opening direction and its first step strikes the contact bridge even earlier, thus resulting in even more effective braking of the opposing closing movement of the contact bridge.

BRIEF DESCRIPTION OF THE DRAWINGS

The invention as well as further advantageous refinements and improvements of the invention will be explained and described in more detail with reference to the drawings, which illustrate three exemplary embodiments of the invention, and in which.

Identical elements or assemblies or elements or assemblies having the same effect are in each case allocated with the same reference numbers in FIGS. 1 to 8.

DETAILED DESCRIPTION

Figure 1A:
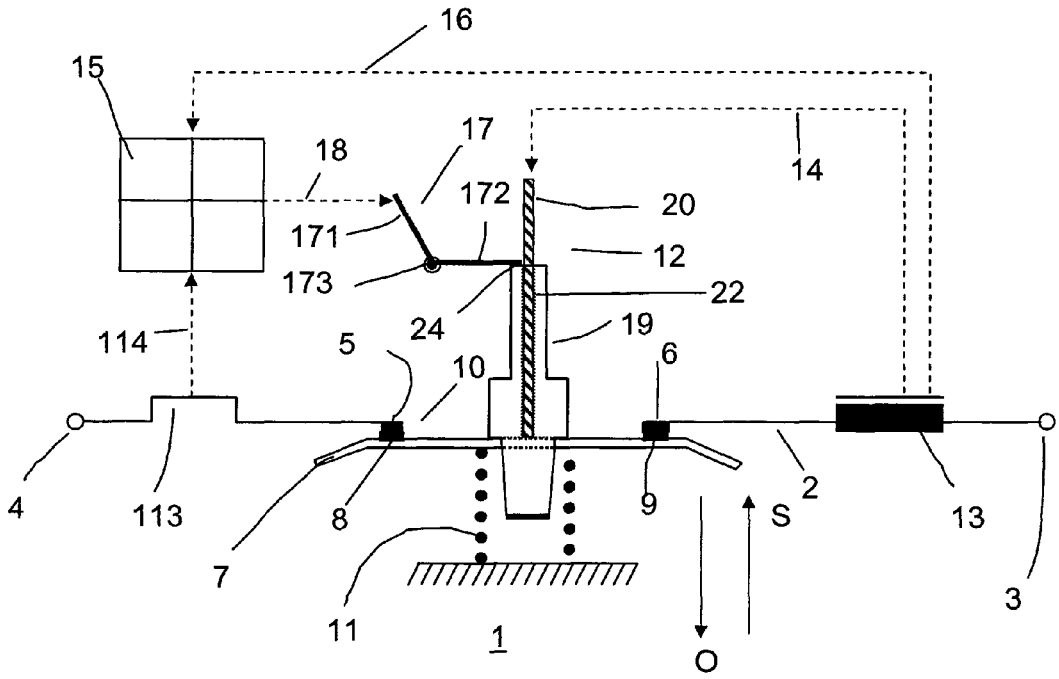
FIG. 1*a* shows a functional layout of an installation switching device according to the invention, with a pusher according to the invention in the rest position.
Figure 1B:
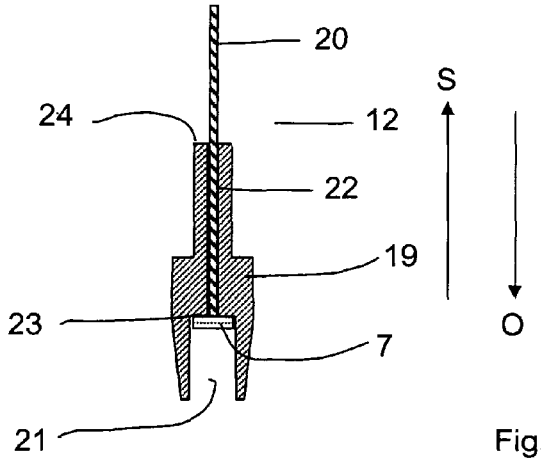
FIG. 1*b* shows a section view of the pusher according to the invention as shown in FIG. 1*a* in the rest position.

FIG. 1 shows an installation switching device 1 according to the invention with a pole current path 2 between an input terminal 3 and an output terminal 4. By way of example, this could be a pole current path of a three-pole motor circuit breaker, whose other two pole current paths are designed in a corresponding manner.

The pole current path 2 comprises two stationary contact pieces 5, 6 and two moving contact pieces 8, 9, which are arranged on a moving contact bridge 7 and form a double-break contact point 10. The contact bridge 7 is acted on by a contact compression spring 11 in the closing direction, see the direction arrow S. The contact bridge 7 can be acted on in the opening direction, see the direction arrow O, by a pusher 12 which acts on the opposite side of the contact bridge 7 to the contact compression spring 11.

The pole current path 2 also has a thermal release 113 and an electromagnetic release 13 with an armature which, when a short-circuit current occurs in the pole current path 2, acts on the contact bridge 7 in the opening direction via the pusher 12 as a result of electrodynamic recoil, indicated by the line of action 14. At the same time, in the event of a short circuit, the armature of the electromagnetic release 13 also acts on a switch latch 15 and unlatches its latching point, indicated by the line of action 16, such that the switch latch 15 permanently acts on the pusher 12 in the opening direction of the contact bridge 7, as indicated by the line of action 18, and via an operating lever 17, in the unlatched state.

The function of the thermal release 113, which likewise acts on the switch latch 15 in the event of an overcurrent, as indicated by the line of action 114, is in principle known and is not the subject matter of the present invention. The thermal release 113 is illustrated here only for the sake of completeness.

By way of example, the mechanical system comprising the switch latch 15 and the operating lever 17 may be a toggle lever system with a two-stage latch. The operating lever 17 is in the form of a double-armed lever whose first lever arm 171, on which the switch latch 15 acts, and whose second lever arm 172, which interacts with the pusher 12, form an obtuse angle with one another, and the operating lever 17 is mounted such that it can rotate in a fixed-position rotating shaft 173, as a result of which the operating lever 17 acts as a direction-shinning lever.

The mechanical system just described has a certain amount of mechanical inertia, as a result of which a certain amount of time, for example 2 to 5 ms, passes after unlatching before the operating lever 17 acts on the pusher 12 in order to act permanently on it in the opening direction.

In contrast, the time before the contact bridge 7 is struck directly by the armature of the electromagnetic release 13 is much shorter and, for example, is only 1 ms.

If no further measures were to be taken, it would therefore be possible for the contact bridge 7 to be forced back again to its original position, in the closed position, just by the resetting force of the contact compression spring 11, and for the contact point 10 to be closed again in this way before the operating lever 17 can still act with the free end of its second arm 171 on the pusher and can thus act permanently on the contact bridge 7 in the open position.

The measures according to the invention, which are taken in order to prevent this, will be described in the following text.

The pusher 12 is formed in two parts. It comprises a slide 19 and a striking pin 20. As can be seen from the section illustration of FIG. 1*b*, the pusher 12 is an elongated component with an approximately cylindrical or cuboid basic shape.

The contact bridge 7 is guided such that it can move in its closing direction and in its opening direction in a first, slot-like opening 21 in the slide 19, which is open at the bottom towards the narrow face of the slide 19.

The striking pin 20 is likewise guided such that it can move in the closing direction and opening direction of the contact bridge 7 in a second, channel-like opening 22 in the slide 19. It overhangs the slide 19 upwards, in the direction of the point of action of the impact armature.

A first step 23 is formed in the first opening 21 of the slide 19, and is used as an upper stop for the contact bridge 7. A second step 24 is formed on the outside of the slide 19, and is used as a point of action for the operating lever 17.

Figure 2A:
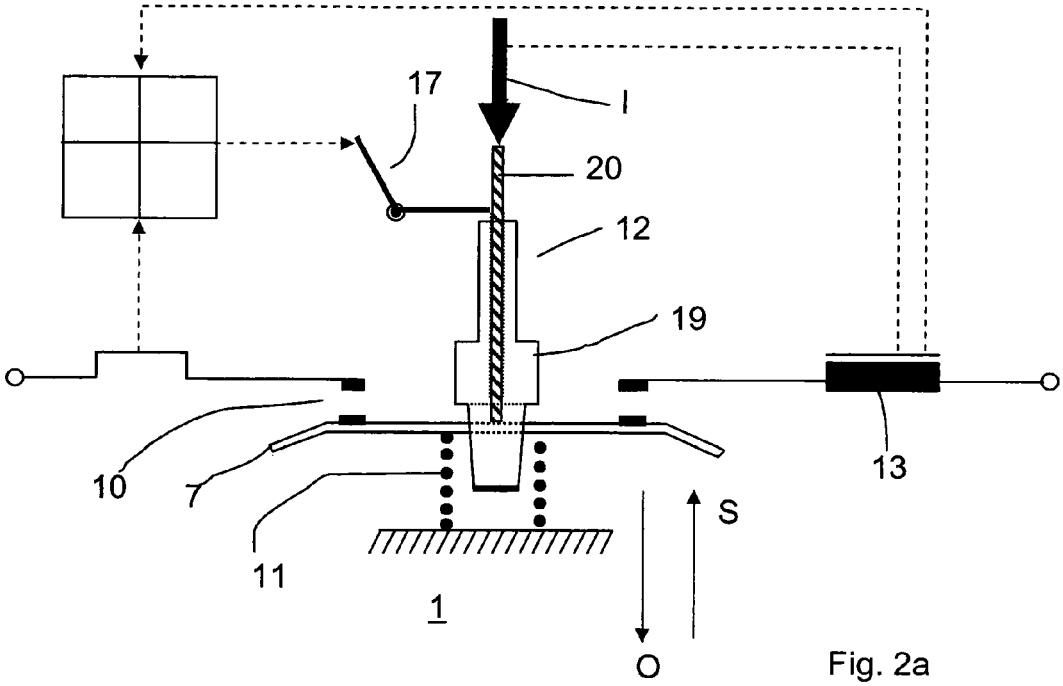
FIG. 2*a* shows a functional layout of an installation switching device according to the invention with a pusher according to the invention shortly after the occurrence of a short-circuit current.
Figure 2B:
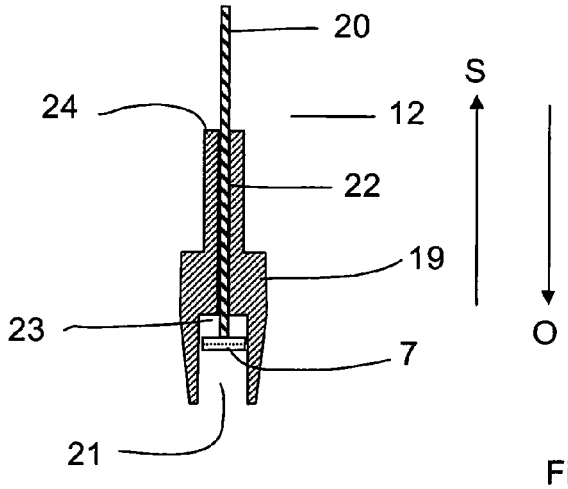
FIG. 2*b* shows a section view of the pusher according to the invention as shown in FIG. 2*a,*
Figure 3A:
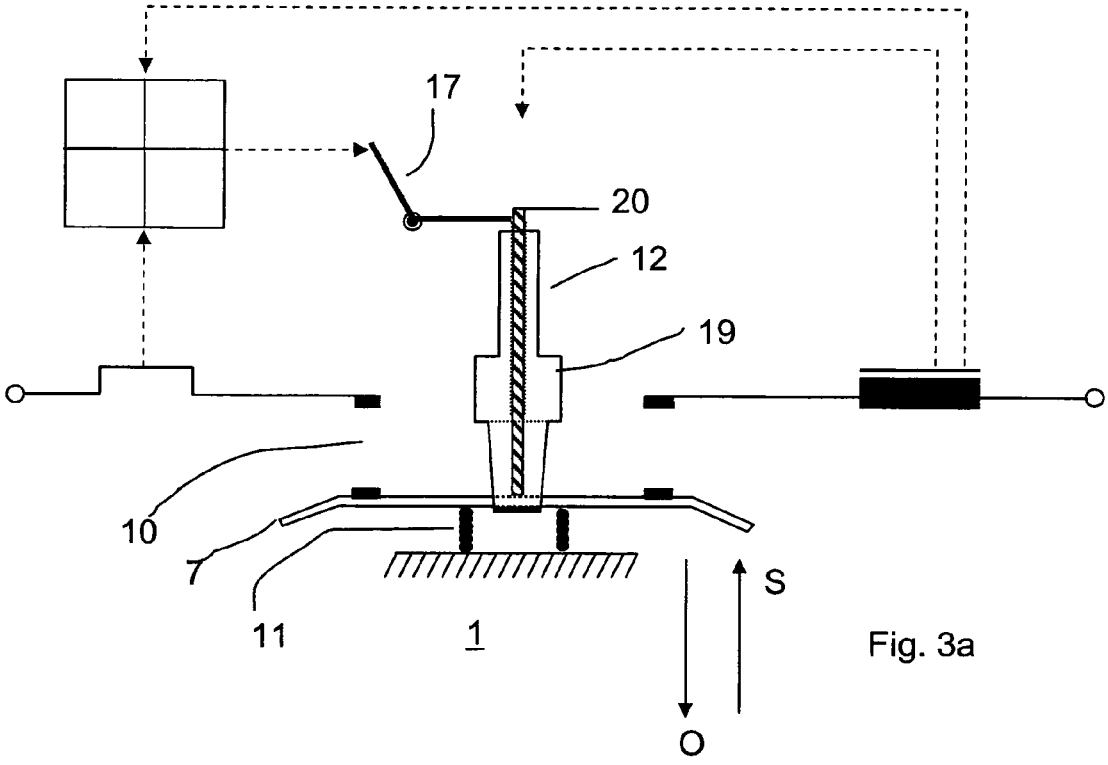
FIG. 3*a* shows a functional layout of an installation switching device according to the invention with a pusher according to the invention at the maximum deflection of a contact bridge in the opening direction.
Figure 3B:
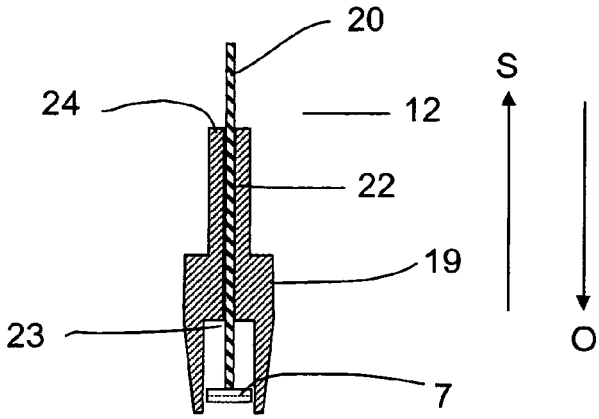
FIG. 3*b* shows a section view of the printer according to the invention as shown in FIG. 3*a,*

The operation of the arrangement according to the invention when a short-circuit current occurs will now be explained in the following text. When a short-circuit current occurs, see FIG. 2*a*, then, as a result of the electrodynamic recoil of the electromagnetic release 13, its armature strikes the striking pin 20 of the pusher 12, indicated by the impulse arrow I in FIG. 2*a*. The striking pin 20 is accelerated downwards in the opening direction O, driving the contact bridge 7 in the opening direction O. The moving contact pieces 8, 9 are thus disconnected from the stationary contact pieces 5, 6, and the double contact point 10 is opened. As a result of the mass inertia, the downwards movement of the striking pin 20 continues, even when the armature has returned to its rest position again after the collapse of the short-circuit current with the contact point 10 open. FIG. 3*a* shows this state, in which the contact bridge 7 has reached its maximum deflection in the opening direction O, driven by the striking pin 20. The contact compression spring 11 is completely compressed.

The slide 19 is driven by the striking pin 20 in the opening direction O, lagging behind the striking pin 20, as a result of a small sliding-friction force between the striking pin 20 and the slide 19 in the interior of the second opening 22.

Figure 4A:
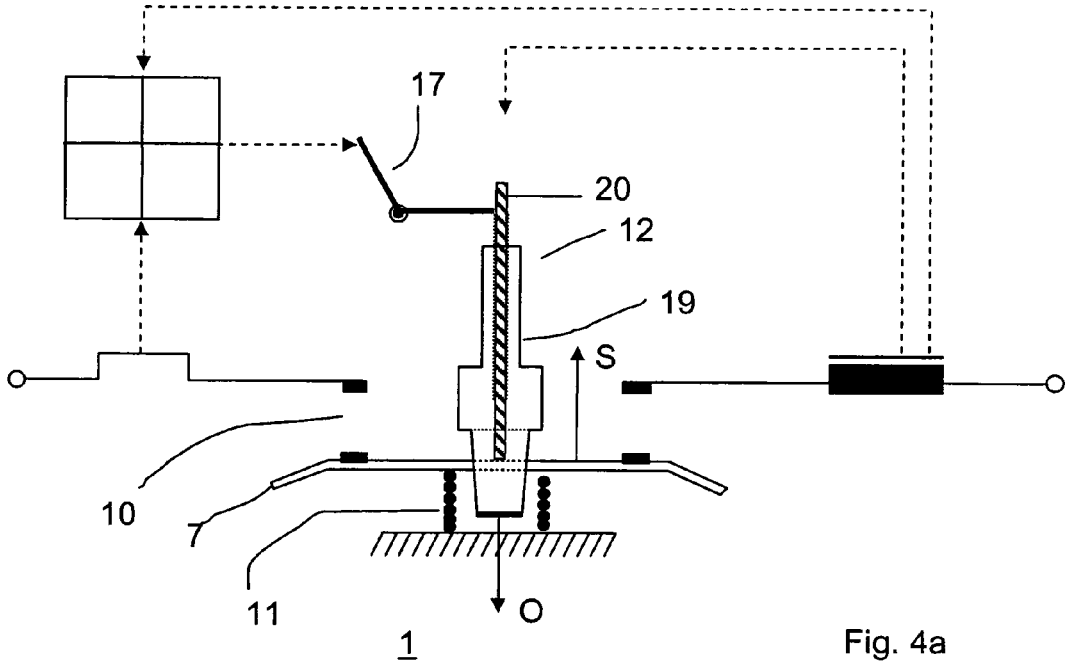
FIG. 4*a* shows a functional layout of an installation switching device according to the invention with a pusher according to the invention during the opposite movement of the contact bridge and of the slide.
Figure 4B:
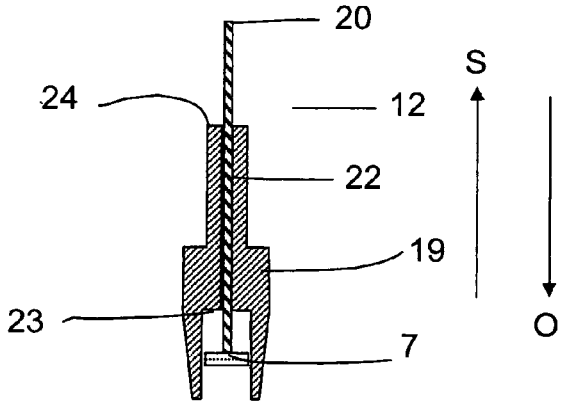
FIG. 4*b* shows a section view of the pusher according to the invention as shown in FIG. 4*a,*

When the maximum deflection of the contact bridge 7 in the opening direction O has been reached, this is acted on upwards in the closing direction S again, by virtue of the resetting force of the contact compression spring 11, and is moved, see FIG. 4*a*. An opposite movement of the contact bridge 7 takes place upwards for a certain amount of time, with the slide 19 moving downwards. When the first step 23 of the slide 19 strikes the contact bridge 7 moving it in the opposite direction to it, then, first of all, the upward movement of the contact bridge 7 is slowed down, in which case, however, after a short delay time, the contact bridge 7 drives the slide 19 on its further upward movement, in the closing direction, via the first step 23. This situation is illustrated in FIGS. 5*a* and 5*b*.

Figure 5A:
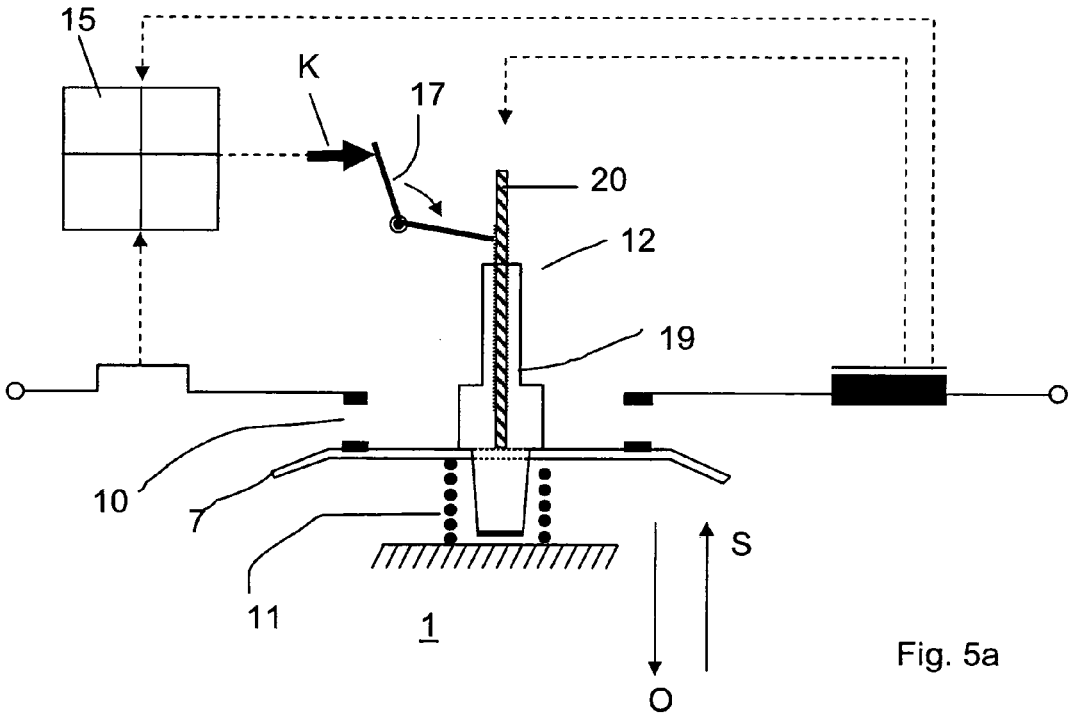
FIG. 5*a* shows a functional layout of an installation switching device according to the invention with a pusher according to the invention at the start of the effect of the switch latch on the operating lever.
Figure 5B:
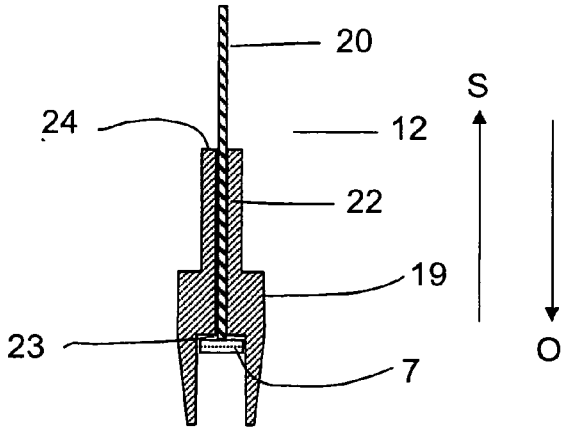
FIG. 5*b* shows a section view of the pusher according to the invention in the position shown in FIG. 5*a,*
Figure 6A:
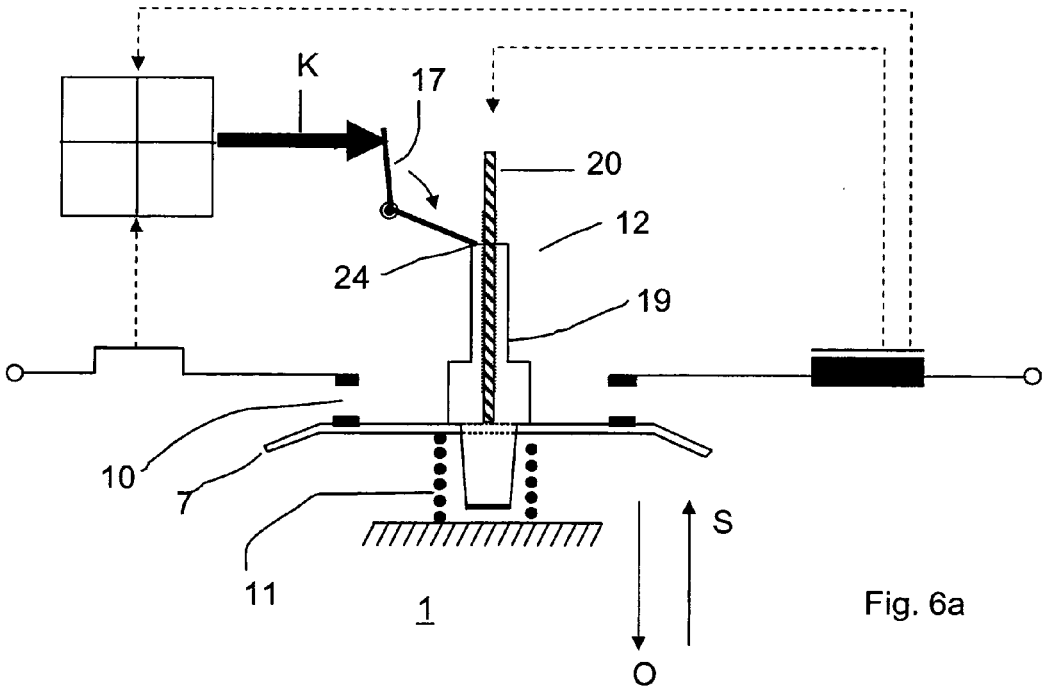
FIG. 6*a* shows a functional layout of an installation switching device according to the invention with a pusher according to the invention in the case of permanent opening by the switch latch via the operating lever.
Figure 6B:
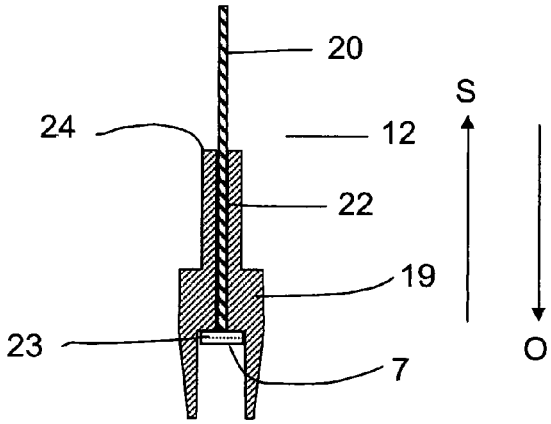
FIG. 6*b* shows a section view of the pusher according to the invention in the position shown in FIG. 6*a,*

FIG. 5*a* illustrates that point in time at which the inertia-dependent delay of the mechanical system comprising the switch latch 15 and the operating lever 17 has ended, and the operating lever 17, which is in the form of a toggle lever, is rotated clockwise by the switch latch 15, indicated by the action arrow K. The contact point 10 is still open.

During a further upward movement in the closing direction S, the second step 24 on the slide 19 strikes the operating lever 17, which is rotated further in the clockwise direction. The switch latch 15 is unlatched and—indicated by the arrow K—holds the operating lever 17 permanently in a position such that it firmly holds the slide 19, via the second step 24, so far in the opening direction O that the contact point 10 remains permanently opened. As can be seen, no contact bouncing has occurred.

The opening of the contact bridge 7 by the armature of the electromagnetic release 13 preferably takes place in the manner described above for low-level and medium-level short-circuit currents. In the case of high-level short-circuit currents, for example of more than 1 to 2 kA, the opening takes place via electrodynamic propulsion between the stationary and moving contact pieces 5, 6; 8, 9. This is also referred to as opening by electrodynamic propulsion between the contact pieces. This opening by electrodynamic propulsion takes place more quickly than opening by the armature, since so mechanically moving intermediate parts are involved, as represented by the armature for example, and, in consequence, no inertia-dependent time delay occurs, either. In this case, the armature initially lags behind the contact bridge. The prevention of the premature closure of the contact point after the initial fast opening as a result of the electrodynamic propulsion then takes place in the subsequent time, however, in precisely the same way as that described above.

Figure 7:
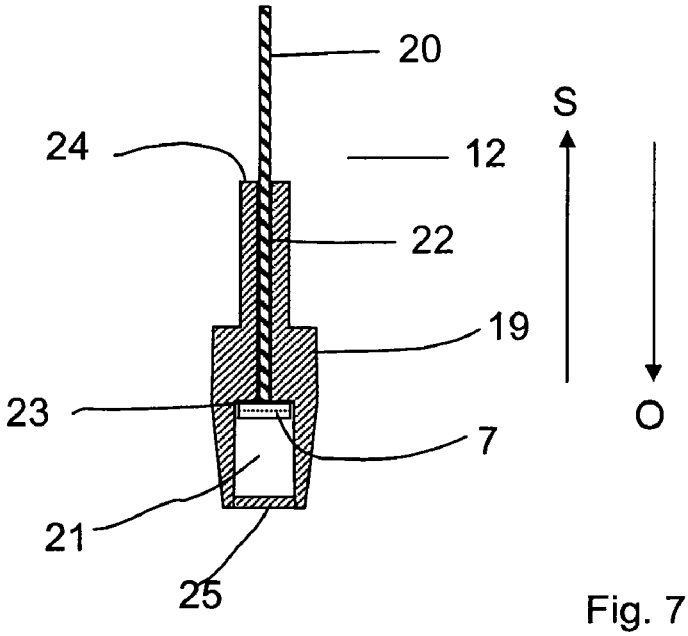
FIG. 7 shows a section view of a pusher according to the invention according to a further embodiment.

FIG. 7 shows a further embodiment of a slide 19*a* according to the invention. In this case, the first opening 21 is closed at the bottom by a web 25. The movement range of the contact bridge 7 is thus bounded in the first opening 21 between the first step 23, which acts as an upper stop, and the web 25. The advantageous effect of the web 25 consists in that, during the downward movement of the striking pin 20, this acts as a lower stop and actively drives the slide 19 downwards in the opening direction. It therefore supports the lagging driving of the slide 19 downwards in the opening direction O by the striking pin 20.

Figure 8:
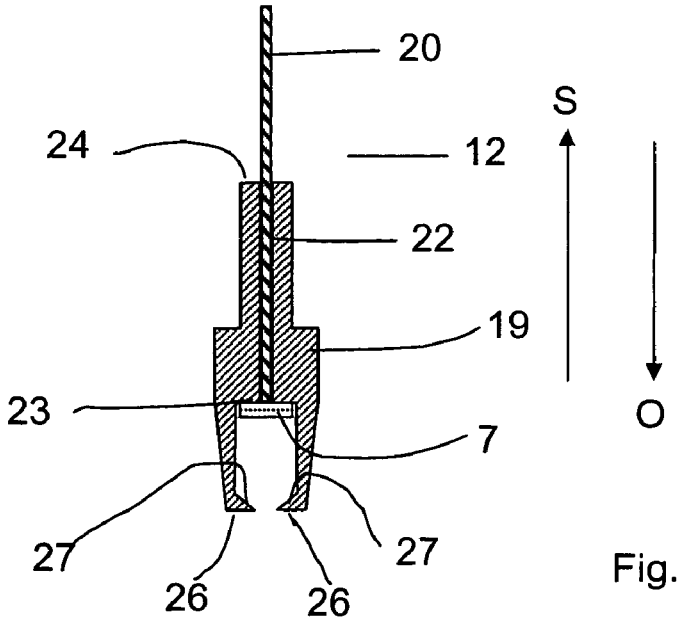
FIG. 8 shows a section view of a pusher according to the invention according to a third embodiment.

FIG. 8 shows a further variant. There, two steps 26, each with inclined side surfaces 27, are fitted at the open end of the opening 21, instead of a continuous web in the first opening 21. In this case, the slide 19 is driven by the contact bridge 7 via the inclined surfaces 27.

Thus, overall, the installation switching device according to the invention comprises two moving systems. The first moving subsystem comprises the striking pin 20 and the contact bridge 7, and the second moving subsystem comprises the slide 19. The two moving subsystems must be designed such that the force of the contact compression spring 11 on the contact bridge 7 is less than the force which the striking pin 20 experiences as a result of the kinetic energy resulting from the impact on it of the armature of the electromagnetic release 13. The mass of the slide 19 must therefore be greater or at least equal to the sum of the masses of the striking pin 20 and the contact bridge 7.

LIST OF REFERENCE SYMBOLS

1 Installation switching device
2 Pole current path
3 Input terminal
4 Output terminal
5, 6 Stationary contact pieces
7 Moving contact bridge
8, 9 Moving contact pieces
10 Contact point
11 Contact compression spring
12 Pusher
13 Electromagnetic release
14 Line of action
15 Switch latch
16 Line of action
17 Operating lever
18 Line of action
19 Slide
20 Striking pin
21 First opening
22 Second opening
23 First step
24 Second step
25 Web
26 Step
27 Inclined slide surface
113 Thermal release
114 Line of action
171 First lever arm
172 Second lever arm
173 Rotation axis

The invention claimed is:

1. An installation switching device having at least one pole current path comprising:

two stationary contact pieces;

a moving contact bridge including two moving contact pieces forming a double-break pole with the two stationary contact pieces;

a contact pressure spring exerting a pressure on the moving contact bridge in a closing direction of the moving contact bridge:

a pusher configured to act on the moving contact bridge counter to the pressure of the contact pressure spring in an opening direction, the pusher including a slide and a striking pin, each disposed moveably relative to the moving contact bridge and to one another in a movement direction of the moving contact bridge, the slide and striking pin having a frictional engagement with one another;

a switch latch operable to activate an operating lever configured to act on the pusher against the pressure of the contact pressure spring; and an electromagnetic release having an impact armature wherein, in a short circuit event, the impact armature is configured to unlatch a latching point of the switch latch so as to initiate an activation of the switch latch and to strike the striking pin so as to move the contact bridge in the opening direction and move the slide, by a friction force corresponding to the frictional engagement with the striking pin, lagging behind the striking pin, before the operating lever permanently engages the slide so as to hold the contact bridge in the open position counter to the contact pressure force.

2. The installation switching device as recited in claim 1, wherein the slide includes a first opening receiving the moving contact bridge and configured to move the moving contact bridge in the movement direction.

3. The installation switching device as recited in claim 1, wherein the slide includes a second opening, and the striking pin is guided in the second opening in the movement direction.

4. The installation switching device as recited in claim 3, wherein the slide has a first step in the first opening forming an upper stop configured to receive the moving contact bridge.

5. The installation switching device as recited in claim 4, wherein the slide has a second step disposed on an outside surface of the slide forming a point of action configured to engage the operating lever.

6. The installation switching device as recited in claim 5, wherein the striking pin, the slide, and the moving contact bridge each have a mass, wherein the mass of the slide is equal to or greater than a sum of the masses of the striking pin and the moving contact bridge.

7. The installation switching device as recited in claim 5, wherein the slide has a third step in the first opening forming a lower stop configured to clamp the moving contact bridge.

8. The installation switching device as recited in claim 5, wherein the slide has a web disposed at a free end of the first opening covering the first opening and forming a lower stop configured to stop the moving contact bridge.

9. The installation switching device as recited in claim 1, wherein an electrodynamic propulsion between the two stationary contact pieces and the two moving contact pieces opens the moving contact bridge and the impact armature lags being the moving contact bridge in the event of a short circuit.

* * * * *